US005233766A

United States Patent [19]

Frederiksen et al.

[11] Patent Number: 5,233,766

[45] Date of Patent: Aug. 10, 1993

[54] VERTICAL GRAIN DRYER

[76] Inventors: Wilfred C. Frederiksen, 16881 Bolero La., Huntington Beach, Calif. 92649; Sun Y. Kim, 2384 Lancaster Ct., Hayward, Calif. 94542

[21] Appl. No.: 894,453

[22] Filed: Jun. 5, 1992

[51] Int. Cl.[5] ..... F26B 17/12

[52] U.S. Cl. ..... 34/171; 34/178; 34/174

[58] Field of Search ..... 34/168, 170, 171, 172, 34/178, 174, 175, 33

[56] References Cited

U.S. PATENT DOCUMENTS

| | | | |
|---|---|---|---|
| 82,432 | 9/1868 | Mills et al. | 34/171 |
| 618,508 | 1/1899 | Hess, Jr. | 34/171 |
| 645,366 | 3/1900 | Mallinson | 34/171 |
| 676,681 | 6/1901 | Mallinson | 34/171 |
| 685,336 | 10/1901 | Leroy et al. | 34/171 |
| 785,554 | 3/1905 | Horner | 34/171 |
| 789,807 | 5/1905 | Holl | 34/171 |
| 2,548,262 | 4/1951 | Hintz | 34/171 |
| 3,864,845 | 2/1975 | Cooper | 34/171 |
| 4,249,891 | 2/1981 | Noyes et al. | 34/171 |

*Primary Examiner*—Henry A. Bennet
*Assistant Examiner*—Denise Gromada
*Attorney, Agent, or Firm*—Bielen, Peterson & Lampe

[57] ABSTRACT

A vertical dryer for granular materials the dryer having a substantially vertical chute into which granular material is deposited, the chute having walls that are at least in part air pervious for passing heated air through the chute, the chute having incline baffles for intercepting and redirecting the granular material during its descent in the chute.

11 Claims, 3 Drawing Sheets

VERTICAL GRAIN DRYER

BACKGROUND OF THE INVENTION

This invention relates to a grain dryer and is particularly useful for the preliminary drying of rice and corn. Many grains require preliminary drying before processing. This enables the grain that is handled in subsequent steps to have a preliminarily lowered moisture content that both protects and preserves the grain during handling and transport to subsequent steps that may vary for different resulting products. For example, treatment steps for use of grain in prepackaged food may differ substantially from those used in canned or other precooked preparations. Before commencing selected processing steps, bulk grains should be uniformly dried to create a protective outer surface to lock in nutrients and flavoring and to assist in toughening the grain for bulk handling.

The step of preliminary drying is generally accomplished at large granaries where massive quantities of grain are treated, stored and shipped. In the conventional vertical drier, a large central plenum, that may be many stories in height, is continuously filled with hot air that escapes through a double-layer wire mesh skin, between which the grain is dropped. As the hot air escapes to the outside, the grain dries as it cascades down between the mesh screens. In general, the mesh screens in the sheath are spaced approximately one foot apart. It has been found that grain dropping between the mesh screens do not substantially mix and that substantially all of the drying is accomplished in the first two to three inches of depth into the decending grain.

The exterior grain is inadequately dried by the dramatically falling air temperature as the air passes through the grain from the inner plenum to the outer atmosphere. Furthermore, overdrying of grain, particularly rice, can cause damage including rupture of the hull rendering the rice less desirable for food processing and suitable for normal feed or mash for alcoholic beverages food fillers or animal feed. In a conventional vertical drier, the lack of mixing results in the stream of feed grain closest to the internal plenum to be overdried and the grain stream closest to the outside atmosphere underdried, such that a substantial lack of uniformity in moisture content occurs. Customarily, this is partially resolved by repeatedly cycling the grain through the vertical drier to achieve the approximate overall consistency and uniformly in moisture contend desired. Individual grains may be overdried and underdried by this averaging method.

The inefficiencies in drying and the requirement of recycling for redrying results substantial wastes in electrical energy and thermal energy. Furthermore, the repeated handling of the grain adds to kernal damage and still does not achieve the consistency in drying that is most desirable for production of premium bulk grain.

These and other problems with existing driers have led to development of an improved drier that allows drying of grain to desired moisture content in a single pass. The improved dryer further accomplishes the drying with an energy savings of approximately one third of the usual energy costs. These and other improvements will become apparent from a consideration this invention in the detailed description of the preferred embodiment.

SUMMARY OF THE INVENTION

The vertical grain drier of this invention is designed to thoroughly mix grain as it is descending in a vertical chute, and uniformly dry the grain by hot air passed through the chute from a central plenum. The grain is uniformly mixed and dried by being passed back and forth between a series of inclined baffles which alternately redirect the grain toward the inside and outside screens that form the chute containing the grain during its decent. Preferably, the baffles are arranged in alternating fashion, first directing the grain toward the inside screen and then directing the grain toward the outside screen. However, the arrangement of the baffles can be altered such that by use of baffle pairs the grain can be mixed and continuously directed toward either the inside screen or outside screen, as desired.

Additionally, in a further alternate embodiment mixing stations having interlaced baffle inclined baffles in which the baffles concurrently direct the grain toward the inside and outside screen simultaneously can be provided with advantage. As the grain is guided and redirected by the baffles, it forms and expanding plume as it continues to descend. As it meets each successive baffle or set of baffles, the dispersed grain is reconsolidated and redirected as desired.

DETAILED DESCRIPTION OF THE PREFERRED EMBODIMENTS

Figure 2:
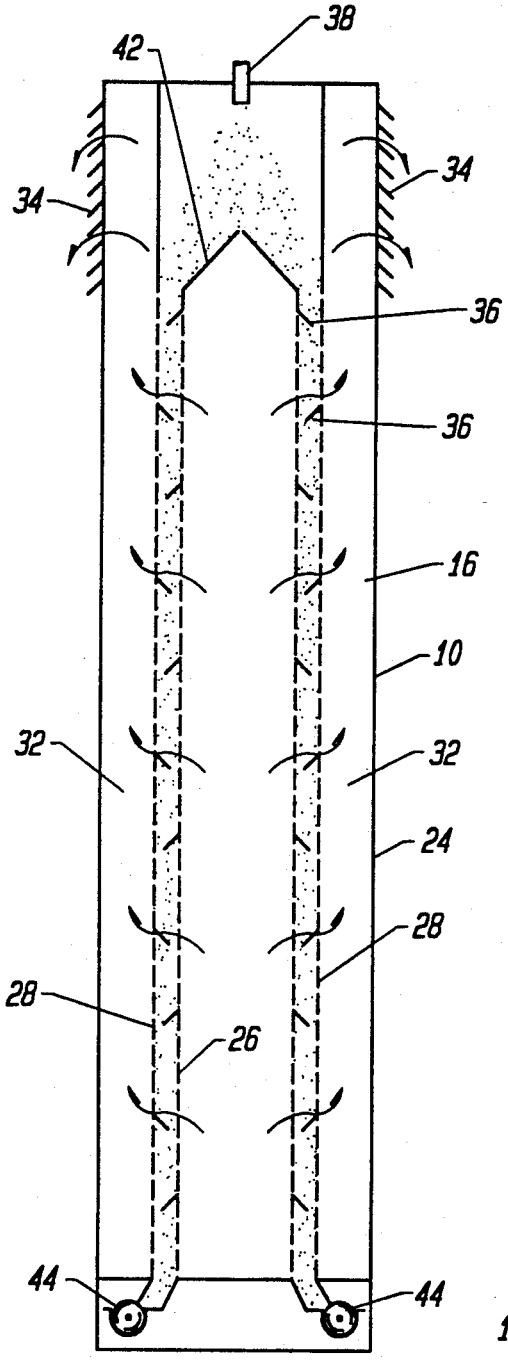
FIG. 2 is a back elevational view of the grain drier of FIG. 1 schematically illustrating the internal operation of the improved drier.
Figure 1:
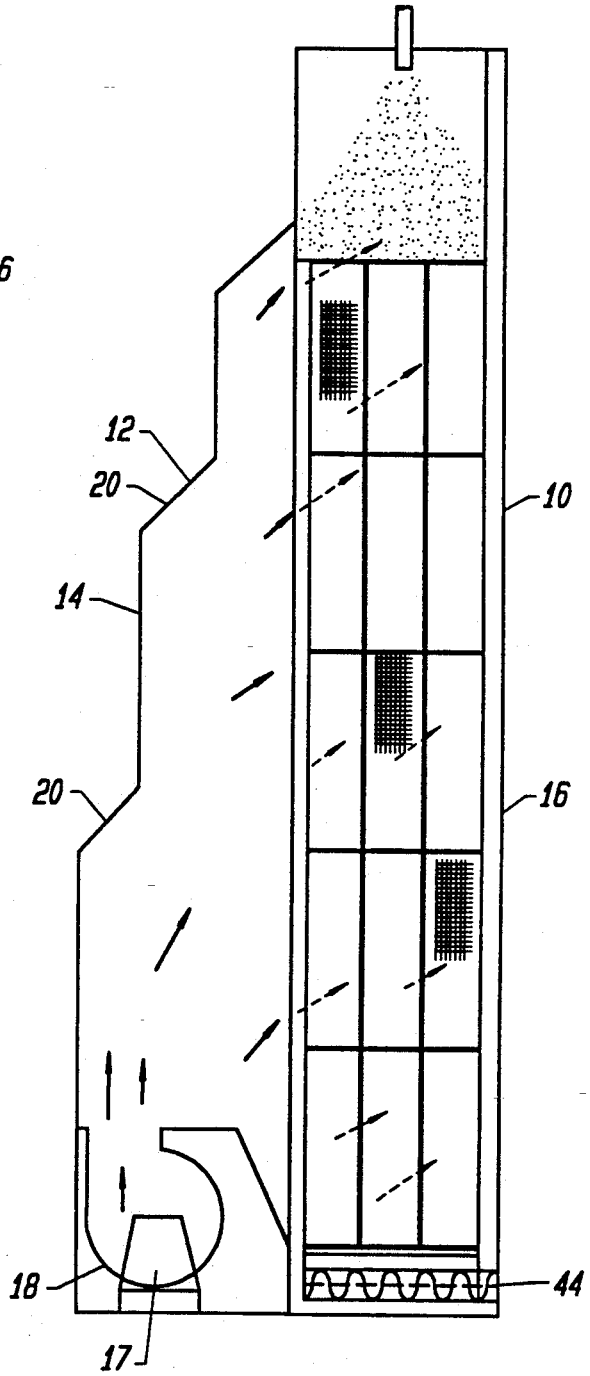
FIG. 1 is a side elevational view of a schematically shown vertical grain drier.

Referring now to FIGS. 1 and 2, the vertical grain drier, designated generally by the reference numeral 10, is shown with an external structure similar to a conventional column drier. In using the term grain drier, it is the intention to include the drying of any granular material, particularly the natural grains including cereal, grasses, and corns. Although a drier with multiple modules similar to that shown in FIGS. 1 and 2 can be included in a single drying operation, each module will have a construction substantially as shown and described for the vertical grain drier of FIGS. 1 and 2.

A vertical grain drier is designed to dry a continuous stream of grain that descends by gravity downward in one or more vertical chutes.

The vertical grain drier 10 has an external housing 12 that is a multi-story structure with an air shroud 14 and a grain column shell 16. The air shroud 14 houses a blower 18 that communicates with a thermal source such as a gas heater 17 to heat air that is introduced into the bottom of the shroud and blown by the blower 18 upwardly and into the grain column shell 16. The shroud 14 has a series of steps 20 to reduce the effective cross-sectional, conduit area of the to distribute the volume of air relatively uniformly into an internal plenum 22 within the center of the grain column shell 16. The grain column shell 16 has an external impervious siding 24 that protects an internal pair of screen chutes 26 from the outside weather. The chutes have inner and outer screen walls 28 and 30 that form an air-pervious containment sheath for containing grain that vertically descends down the chute 26. As the grain descends in the air-pervious screen chute 26, air from the blower 18, directed by the hood-like shroud 14 enters the central plenum 22 and passes through the air-pervious walls of the chute to exhaust ducts 32, formed by the outer screen wall 28 and the siding 24 of the grain column shell 16. As the air passes through the screen chute 26, it drys the grain as the grain descends.

Because grain is easily damaged by elevated drying temperatures, individual grains cannot be long exposed to the initial heat of the hot air passing from the central plenum to the outer duct 32. For example, rice is generally heated at no more than 130° fahrenheit and frequently cycled multiple times with intermittent cooling periods to prevent pressure or damage to the hull. Because of the relatively low temperature of the passing air, the air rapidly cools as it passes through the stream of rice to the exhaust duct 32. Grain located on the duct side of the grain chute 26 is inadequately heated, while grain located on the plenum side of the chute 26 is often overheated during the descent. The cooled exhaust air carrying moisture from the grain rises up the exhaust ducts 32 and is exhausted at the top of the grain column shell 16 through gate 34.

To solve the problem of lack of uniformity in drying of grain in conventional driers, the grain chutes 26 in the improved drier are equipped with a series of baffles 36 to alternately redirect the flow of grain first toward one of the screen wall and then toward the other screen wall. In this manner, the thin sheet of grain descends from each baffle 36 until the next baffle is reached at which point the grain stream is refocused and redirected toward the opposite screen wall. In each successive redirection, the grain is thoroughly mixed such that the flow stream is altered at each stage resulting in grain mixing and uniform drying. As shown in FIG. 2, grain enters from a charge 38 at the end of a feed bin or conveyer duct (not shown) and enters an open upper chamber 40 in the grain column shell 16. The top of the plenum 22 has a apex-like cap 42 that divides the grain being discharged from the grain feed conduit 38 into two streams, directed to each of the two screen chutes 26 in the grain column shell. The grain follows a back and forth path in its descent until it reaches the rotary discharge screws 44 at the base of the column shell 16 for collection and conveyance of the dried grain to a transport mechanism (not shown).

Figure 3:
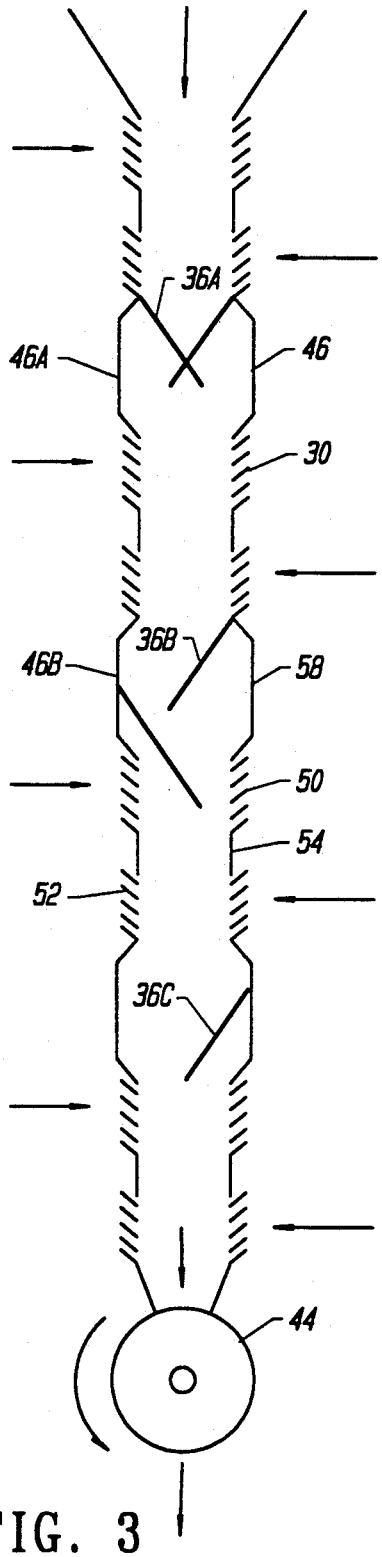
FIG. 3 is a schematic illustration of a vertical grain chute including three different baffle arrangements for improved grain drying.
Figure 4:
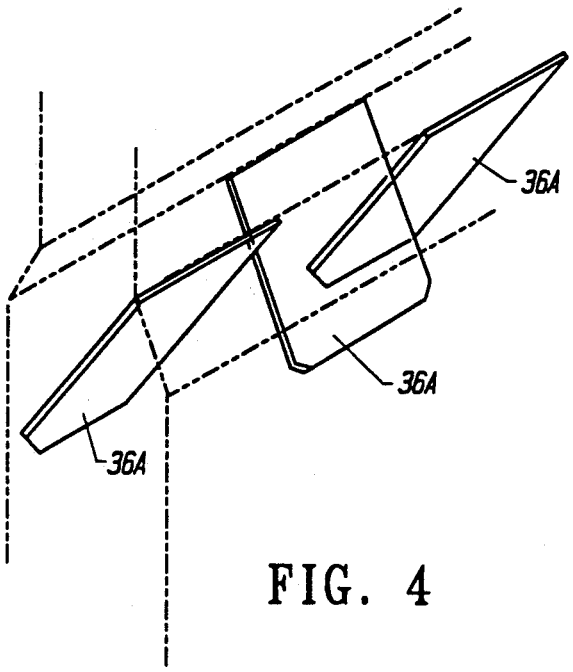
FIG. 4 is a special perspective view of an interlaced baffle station.
Figure 5:
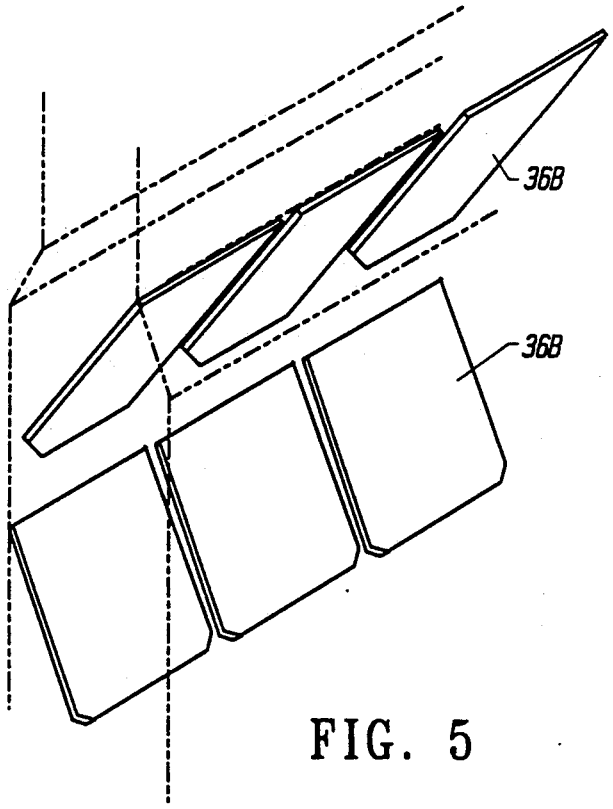
FIG. 5 is a partial view of a double-set baffle station.

As shown in FIG. 3–5, the incline baffles 36 can be arranged in baffle stations 46 having different arrangements of the diverting baffles 36. For example, in station 46*a*, a series of interlaced baffles 36*a*, as shown in greater detail in FIG. 4, are provided for aggressive mixing and division of the grain stream into two separate streams. Each stream is directed toward the opposite screen wall 30.

The screen chute 26*a* of FIG. 3 is somewhat modified from the more traditional chute of FIG. 2. In the modified screen chute 26*a*, the cross flow is directed from each of the screen walls 50 and 52 creating certain turbulence within the grain chute 48 for thorough mixing. As shown in the schematic illustration of FIG. 3, the screen walls 50 and 52 can be interrupted with periodic impervious segments 5 and protected expansion segments 58 where grain is collected on the baffles 36 in between exposure to the cross flow of air.

In the baffle station 46*b*, a set of baffles 36*b* as shown in FIG. 5, is disclosed to thoroughly mix the descending grain but redirect the grain differentially toward one screen wall in preference to the other. In station 46*c*, a conventional set of single baffles 36*c* is installed to cooperate with an oppositely directed set of baffles 36, as shown in the alternating set arrangement of FIG. 2.

With a sufficient number of stations and sufficient heat passing across the grain, grain can be dried in a single pass. In such situations, it may be advantageous to have the cross flow of air proximate the screw conveyer 44, a cooling air steam to prevent cooking the grain by the heat remaining in the grain after the grain has left the drier and is confined to a storage bin for transportation or milling.

Figure 6:
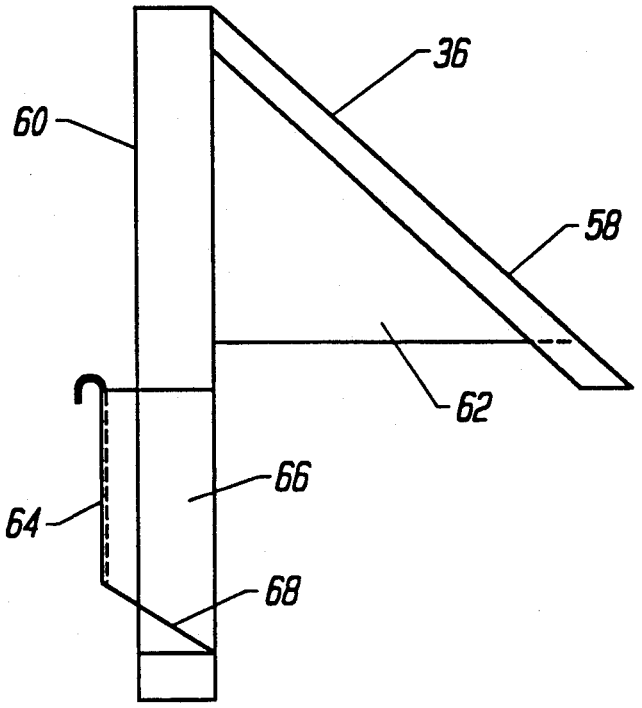
FIG. 6 is a side elevational view of a typical baffle construction.

Typically, as shown in FIG. 6, a baffle 36 is constructed with an inclined panel member 58 attached to a vertical support member 60 and reenforce by a triangular gusset 62. Each station includes one or more sets of incline panel members 58 arranged such that the panel members are aligned in the same plane. For access to the baffle 36, a sliding gate 64 is installed in the vertical member 60 to allow access to the end of the incline panel member 58 in the event any blockage occurs from grain and any unwanted chaff. The slide gate 64 allows opening of an access port 66 having an incline shelf 68 to prevent any unwanted collection of material on the shelf that would interfere with access during maintenance.

The incline element 58 is preferably made from a material that will do minimal damage to the material being processed and can comprise steel, wood, or a rigid core material with a resilient surface. In this manner, the granular material will impact the baffles with little or no damage to the material being dried.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A vertical dryer for granular materials comprising:

a) a substantially vertical, drying chute having a top and a bottom end at least two walls with air-pervious containment means for containing granular material and allowing an air stream to pass through at least portions of the chute and granular material descending the chute;

b) thermal means for generating a flow of heated air;

c) conduit means connected the thermal means and the drying chute for directing heated air through the chute;

d) deposit means for depositing granular material in the chute;

e) baffle means within the chute mounted to at least one wall of the chute for intercepting and redirecting granular material falling on its decent in the chute, wherein the granular material is mixed during its decent; and, f) collection means for collection granular material that has descended in the chute; wherein the baffle means includes at least one baffle station having a set of multiple, incline, substantially rectangular, panel members, each having an end and sides, the panel members in each set being spaced apart and aligned in a common plane to allow granular materials to fall from the sides and end of each panel member for improved mixing.

2. The dryer of claim 1 wherein the thermal means comprises a gas heater and air blower.

3. The dryer of claim 1 wherein the conduit means comprises a shroud between part of the thermal means and at least part of one wall of the drying chute wherein heated air is conveyed from the thermal source to the drying chute.

4. The dryer of claim 1 wherein the baffle means comprises a plurality of spaced baffle stations in the chute, each station having at least one set of incline panel members.

5. The dryer of claim 4 wherein the panel members in successive stations are mounted on opposite walls of the chute and inclined in opposite directions.

6. The dryer of claim 1 wherein the air pervious containment means comprise screens.

7. The dryer of claim 1 wherein the drying chute has walls with air-impervious segments interposed between air-pervious segments.

8. The dryer of claim 7 wherein the baffle means are mounted in the air-impervious segments.

9. The dryer of claim 8 wherein the air-impervious wall segments have access means for providing access to the panel members for cleaning.

10. The dryer of claim 1 comprising further, means for providing cooling air through the chute proximate the collection means.

11. The dryer of claim 1 wherein the collection means comprises a screw conveyer proximate the bottom of the chute.

* * * * *